US009162835B2

(12) United States Patent
Doshida et al.

(10) Patent No.: US 9,162,835 B2
(45) Date of Patent: Oct. 20, 2015

(54) ROLLER MEMBER, SHEET FEEDER AND IMAGE FORMING APPARATUS

(71) Applicant: KONICA MINOLTA, INC., Chiyoda-ku, Tokyo (JP)

(72) Inventors: Yuki Doshida, Toyokawa (JP); Akio Kimura, Kosai (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/601,917

(22) Filed: Jan. 21, 2015

(65) Prior Publication Data

US 2015/0210489 A1 Jul. 30, 2015

(30) Foreign Application Priority Data

Jan. 27, 2014 (JP) ..... 2014-011944

(51) Int. Cl.
*B65H 3/06* (2006.01)
*B65H 5/06* (2006.01)
*B65H 29/20* (2006.01)

(52) U.S. Cl.
CPC ..... *B65H 3/0638* (2013.01); *B65H 5/06* (2013.01); *B65H 29/20* (2013.01); *B65H 2404/134* (2013.01); *B65H 2404/1342* (2013.01); *B65H 2404/13421* (2013.01)

(58) Field of Classification Search
CPC ..... B65H 3/06; B65H 3/0638; B65H 5/06; B65H 29/20; B65H 2404/134; B65H 2404/1341; B65H 2404/1342; B65H 2404/13421
See application file for complete search history.

(56) References Cited

U.S. PATENT DOCUMENTS

| | | | | |
|---|---|---|---|---|
| 4,872,247 | A * | 10/1989 | Nakamura et al. | 492/40 |
| 6,059,280 | A | 5/2000 | Yamauchi et al. | |
| 2002/0050682 | A1* | 5/2002 | Tuyuki et al. | 271/264 |
| 2006/0017213 | A1* | 1/2006 | Maeda et al. | 271/10.01 |
| 2006/0180985 | A1* | 8/2006 | Lee et al. | 271/109 |
| 2008/0101842 | A1* | 5/2008 | Takahashi | 400/617 |

FOREIGN PATENT DOCUMENTS

| | | | |
|---|---|---|---|
| JP | 09188434 | A | 7/1997 |
| JP | 2009269686 | A | 11/2009 |

* cited by examiner

*Primary Examiner* — David H Bollinger
(74) *Attorney, Agent, or Firm* — Holtz, Holtz, Goodman & Chick PC

(57) ABSTRACT

In a roller member where a rotary shaft is inserted through a through-hole of a roller part so that the roller part is removably mounted on the rotary shaft, the rotary shaft is provided with a positioning retention part for retaining one end of the roller part. Further, the rotary shaft is provided with an engagement recess at place on its portion outward of the other end of the roller part. An engagement protrusion is provided at a snap fit portion extended axially outward from the other end of the roller part. In a state where the snap fit portion is elastically deformed in a direction opposite to the extension direction, the engagement protrusion is engaged with the engagement recess.

7 Claims, 5 Drawing Sheets

ROLLER MEMBER, SHEET FEEDER AND IMAGE FORMING APPARATUS

RELATED APPLICATION

The priority application Number Japanese Patent Application 2014-11944 upon which this application is based is hereby incorporated by reference.

BACKGROUND OF THE INVENTION

1. Field of the Invention

The present invention relates to a roller member used for sheet feed or the like and to a sheet feeder and an image forming apparatus which employ such a roller member. Particularly, in a roller member where a rotary shaft is inserted through a through-hole of a roller part and the roller part is removably mounted on a periphery of the rotary shaft, a feature of the invention is that the roller member is adapted to prevent the displacement of the roller part mounted on the periphery of the rotary shaft and to properly retain the roller part at a predetermined position on the rotary shaft.

2. Description of the Related Art

In image forming apparatuses such as copiers and printers, the sheet feeder adapted to feed a sheet by rotating the roller member has conventionally been used for feeding and transporting the sheet such as recording paper from a paper cassette or the like.

A roller body, such as disclosed in Patent Document 1 (Unexamined Patent Publication No. H09-188434), where the roller part is integrally mounted on the periphery of the rotary shaft is used as the above-described roller member. In the case of deterioration or the like of the roller part, the entire roller body is replaced. Alternatively, the above-described roller member may be a separation roller, as disclosed in Patent Document 2 (Unexamined Patent Publication No. 2009-269686), which has a structure where the rotary shaft is inserted through a through-hole of the roller part and the roller part is removably mounted on the periphery of the rotary shaft. In the case of deterioration or the like of the roller part, the roller part is removed from the rotary shaft so that only the roller part is replaced.

It is noted here that the roller body as set forth in the above Patent Document 1 has a problem that when the roller part is deteriorated, the entire roller body is replaced so that the cost increases.

In the case of the separation roller set forth in the above Patent Document 2, the roller part is removably mounted on the periphery of the rotary shaft by engaging a snap fit claw formed on the inside of a core material of the roller part with a groove formed in the periphery of the rotary shaft.

However, in the structure where the roller part is mounted on the periphery of the rotary shaft by simply engaging the snap fit claw formed on the inside of the core material of the roller part with the groove formed in the periphery of the rotary shaft, a gap is produced between the snap fit claw and the groove. This leads to rattling of the roller part mounted on the rotary shaft. Hence, when the sheet such as the recording paper is fed and transported from the paper cassette, the sheet may be shifted, leading to a misfeed.

Therefore, the Patent document 2 proposes a structure where a guide cover is rotatably mounted to one end of the roller part. This guide cover is rotated in a direction to move away from the roller part so as to permit the roller part to be separated from the rotary shaft. On the other hand, after the roller part is mounted on the rotary shaft, this guide cover is rotated toward the roller part so that a control wall disposed at this guide cover can control the axial rattling of the roller part.

However, the provision of the guide cover at the one end of the roller part leads to the increase in the number of parts and thence, to the cost increase. What is more, a space for the guide cover is required so that an apparatus grows in size. Further, the replacement of the roller part requires an operation of rotating the guide cover away from the roller part and separating the roller part from the rotary shaft as described above and an operation of rotating the guide cover toward the roller part after the roller part is mounted on the rotary shaft. The operation of replacing the roller part is cumbersome and takes much time.

SUMMARY OF THE INVENTION

Disclosure of the Invention

Problems to Be Solved by the Invention

A roller member according to the invention includes: a rotary shaft; a roller part including a through-hole for insertion of the rotary shaft and removably mounted on a periphery of the rotary shaft; and a positioning retention part for positioning one end of the roller part, wherein the rotary shaft includes an engagement recess having a concave shape and formed in a portion extended beyond the other end of the roller part mounted on the rotary shaft, the roller part includes a snap fit portion which is extended axially outward from the other end thereof and includes an engagement protrusion for engagement with the engagement recess, and the snap fit portion brings the engagement protrusion thereof into engagement with the engagement recess as elastically deformed in a direction opposite to the extension direction, while the one end of the roller part is pressed against the positioning retention part by an elastic restoring force of the snap fit portion.

A sheet feeder according to the invention employs the above roller member for sheet feed using a roller member.

An image forming apparatus according to the invention uses the above sheet feeder employing the above roller member as a sheet feeder for sheet feed using a roller member.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
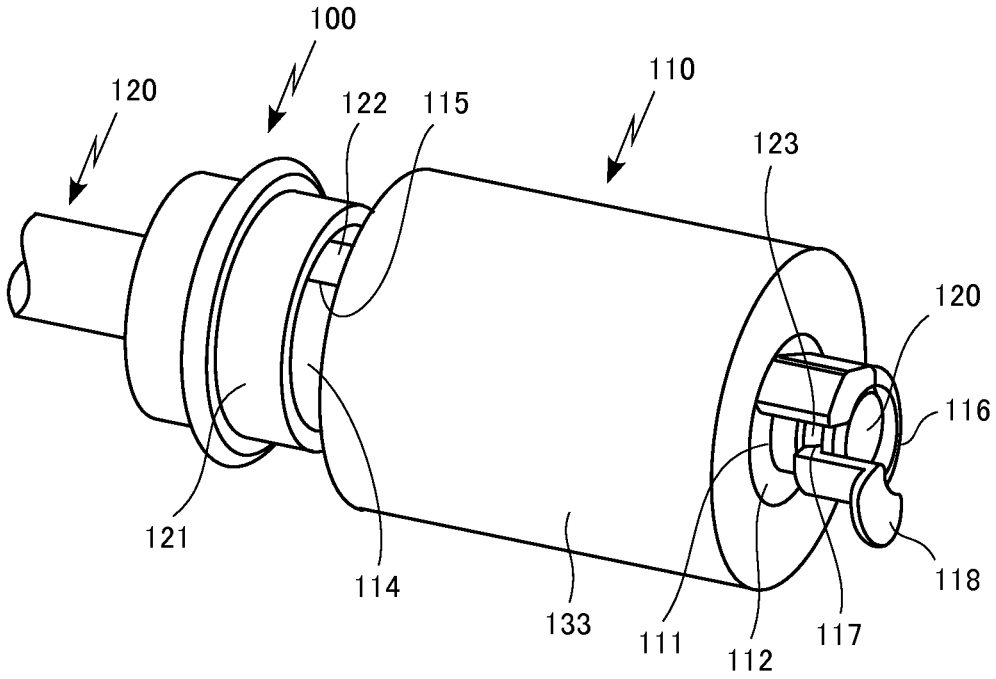
FIG. 1 is a schematic fragmentary perspective view showing a roller member according to an embodiment of the invention in which a roller part is removably mounted on a periphery of one end of a rotary shaft.

In a roller member according to the invention, the following arrangement is made such that a rotary shaft is inserted through a through-hole of a roller part and the roller part is removably mounted on a periphery of the rotary shaft. The rotary shaft is provided with a positioning retention part for positioning one end of the roller part. The rotary shaft inserted through the through-hole of the roller part is also formed with an engagement recess at its portion extended outward of the other end of the roller part. An elastically deformable snap fit portion is axially extended outward of the other end of the roller part. This snap fit portion is formed with an engagement protrusion to be engaged with the above engagement recess. As elastically deformed in the direction opposite to the extension direction, the snap fit portion brings the engagement protrusion thereof into engagement with the engagement recess formed at the rotary shaft. An elastic restoring force of the snap fit portion is used to press the one end of the roller part against the positioning retention part formed at the rotary shaft.

If this snap fit portion, as elastically deformed in the direction opposite to the extension direction, brings the engagement protrusion formed thereon into engagement with the engagement recess formed at the rotary shaft, and the elastic restoring force of the snap fit portion is used for pressing the one end of the roller part against the positioning retention part of the rotary shaft, the roller part is retained in position as pressed against the positioning retention part of the rotary shaft.

Accordingly, the above roller member features a simple structure for reliably preventing the displacement of the roller part mounted on the periphery of the rotary shaft and properly retaining the roller part at a predetermined position on the rotary shaft. When such a roller member is rotated for feeding a sheet, the sheet is properly fed without fear that the roller part mounted on the periphery of the rotary shaft is displaced and rattles.

In a case where the above roller part employs an element which includes a cylindrical base having the through-hole, and an elastic roller formed of an elastic material and mounted on a periphery of the cylindrical base, the above snap fit portion is extended axially outward from the other end of the cylindrical base of this roller part. If the elastic roller is mounted on the periphery of the cylindrical base, the roller part is adapted for proper feeding of sheet or the like.

The above snap fit portion may be provided with a press portion to permit this snap fit portion to be depressed in the direction opposite to the extension direction. The provision of the press portion facilitates an operation of elastically deforming the snap fit portion in the direction opposite to the extension direction by pressing down this press portion, and thus bringing the engagement protrusion formed on this snap fit portion into engagement with the engagement recess formed at the rotary shaft.

The elastically deformable snap fit portion may be extended axially outward from the other end of the roller part in the following manner, for example. The snap fit portion may be formed in a spiral shape extended in a circumferential direction of the rotary shaft and projected axially outward from the other end of the roller part.

If the positioning retention part of the rotary shaft and the one end of the roller part positioned and retained by this positioning retention part are each provided with a rotation transmission engagement portion for transmitting the rotation of the rotary shaft to the roller part, the above rotation transmission engagement portions are engaged with each other in a state where the roller part is pressed against the positioning retention part of the rotary shaft and thereby positioned and retained thereon, as described above. Hence, the roller part is adapted for proper rotation in conjunction with the rotation of the rotary shaft.

Next, the roller member, sheet feeder and image forming apparatus according to embodiments of the invention are described in detail with reference to the accompanying drawings. It is noted that the roller member, sheet feeder and image forming apparatus according to the invention are not limited to the following embodiments but the invention can be appropriately carried out in various ways without departing from the spirit or essential characteristics thereof.

In a roller member 100 according to this embodiment, as shown in FIG. 1, a rotary shaft 120 is inserted through a through-hole 111 of a roller part 110 whereby the roller part 110 is removably mounted on a periphery of one end of the rotary shaft 120.

Figure 2:
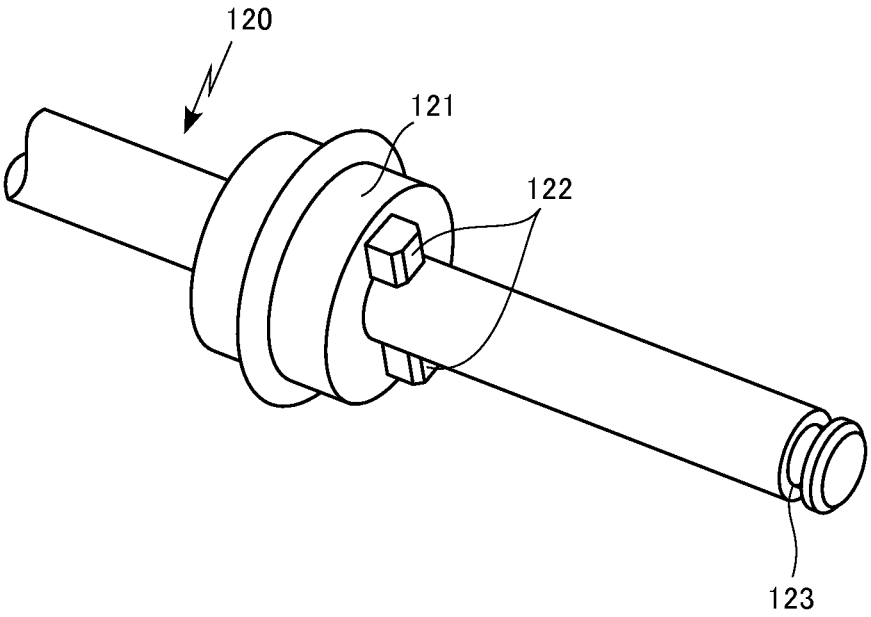
FIG. 2 is a schematic fragmentary perspective view showing the rotary shaft used in the above roller member.

While the rotary shaft 120 is inserted through the through-hole 111 of the roller part 110, a positioning retention part 121 for positioning and retaining one end of the roller part 120 is disposed on the rotary shaft 120 at place a required distance from an insertion-direction distal end of the rotary shaft 120, as shown in FIG. 2. A rotation transmission engagement portion 122 having a protruded shape and serving to transmit the rotation of the rotary shaft 120 to the roller part 110 is provided at this positioning retention part 121 on a side opposed to the roller part 110. Further, an engagement recess 123 is formed in the periphery of the insertion-direction distal end of the rotary shaft 120.

Figure 3A:
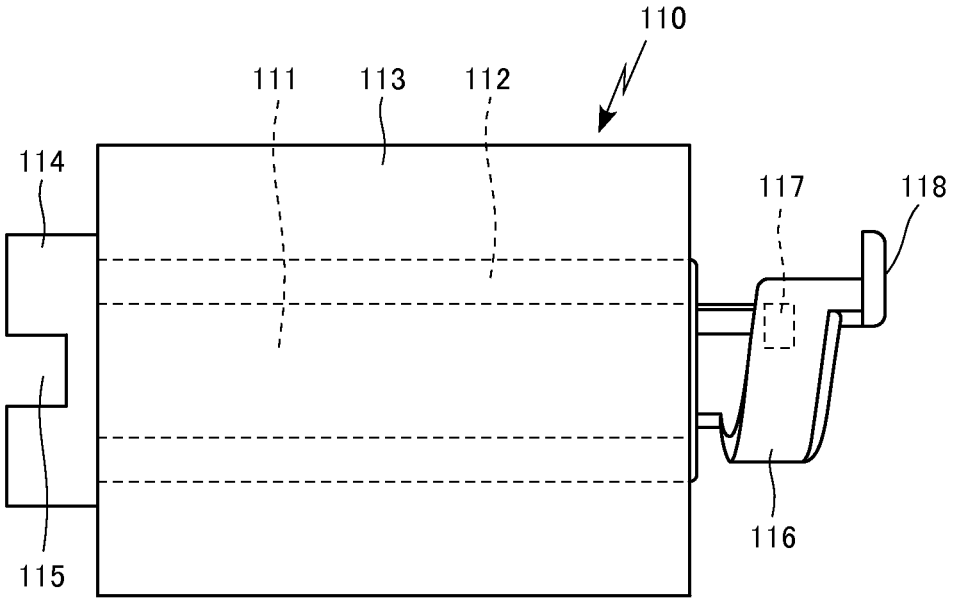
FIG. 3A is a schematic front view showing the roller part used in the above roller member.
Figure 3B:
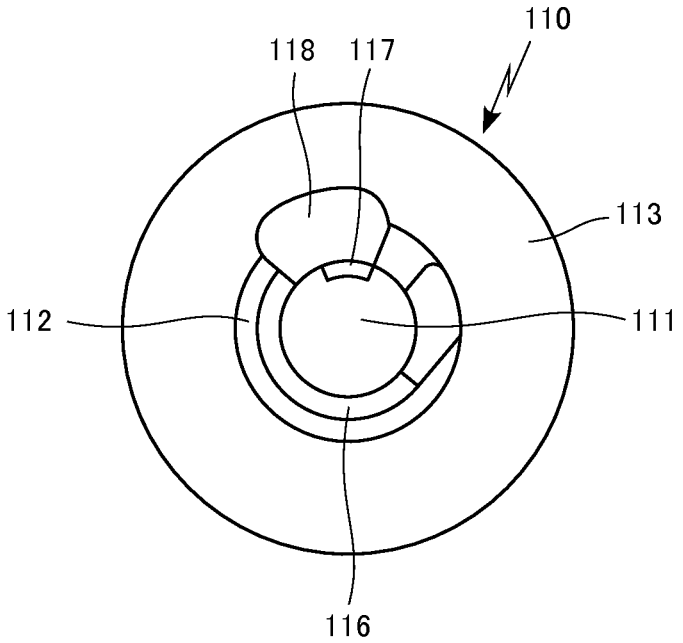
FIG. 3B is a schematic side view of the roller part used in the above roller member as seen from a side where a snap fit portion is provided.

On the other hand, as shown in FIG. 3A and FIG. 3B, the above roller part 110 employs an element that includes a cylindrical resin base 112 having the through-hole 111, and an elastic roller 113 formed of an elastic material such as rubber and mounted on a periphery of the cylindrical base.

The above cylindrical base 112 is formed with a projection 114 on one end thereof that is opposed to the positioning retention part 121 of the rotary shaft 120, the projection 114 projecting more than the elastic roller 113 toward the positioning retention part 121. This projection 114 is formed with a groove-like rotation transmission engagement portion 115 at place opposed to the positioning retention part 121, the engagement portion 115 engaging with the rotation transmission engagement portion 122 having the protruded shape and disposed at the positioning retention part 121 of the rotary shaft 120.

From the other end of the cylindrical base 112 opposite from the above projection 114, a snap fit portion 116 is spirally extended in the circumferential direction of the rotary shaft 120 and projected axially outward. The snap fit portion 116 is formed with an engagement protrusion 117 on an inside periphery thereof at place spaced from the cylindrical base 112, the engagement protrusion engageable with the engagement recess 123 formed in the periphery of the insertion-direction distal end of the rotary shaft 120. The snap fit portion 116 is further formed with a press portion 118 at an extended-side end thereof such that this snap fit portion 116 can be depressed in the direction opposite to the extension direction.

Figure 4A:
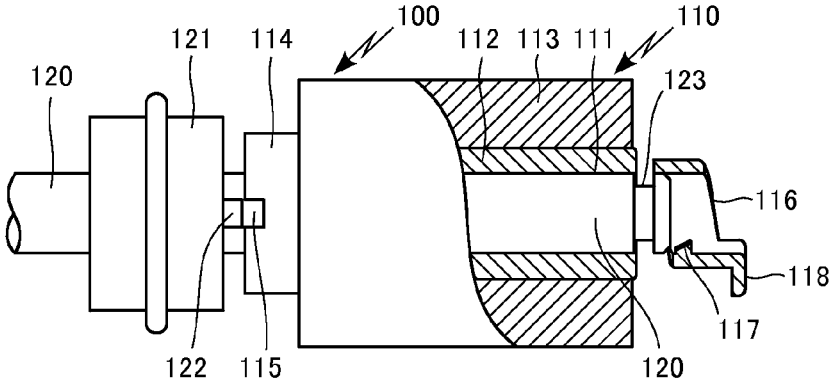
FIG. 4A is a schematic explanatory diagram partly in section showing the above roller member where an insertion-direction distal end of the rotary shaft is inserted through a through-hole of the roller part from one end thereof and projected beyond the other end of the roller part where the snap fit portion is provided.

In the roller member 100 according to this embodiment, the following procedure is taken to removably mount the roller part 110 on the periphery of the one end of the rotary shaft 120. As shown in FIG. 4A, the insertion-direction distal end of the above rotary shaft 120 is inserted in the through-hole 111 from the projection 114 at the one end of the cylindrical base 112 of the above roller part 110. This insertion-direction distal end of the rotary shaft 120 is inserted through the through-hole 111 of the roller part 110 and projected from the other end of the cylindrical base 112, at which end the snap fit portion 116 is formed.

Figure 4B:
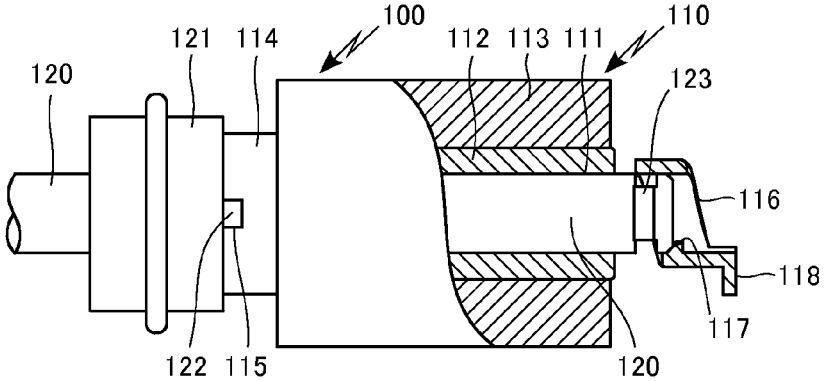
FIG. 4B is a schematic explanatory diagram partly in section showing the above roller member where the insertion-direction distal end of the rotary shaft is inserted into an inside periphery of the snap fit portion spirally extended outward in an axial direction and contacted against an engagement protrusion while the one end of the roller part is contacted against a positioning retention part of the rotary shaft so that a rotation transmission engagement portion of the rotary shaft and a rotation transmission engagement portion of the roller part are engaged with each other.

As shown in FIG. 4B, the rotary shaft 120 is further inserted through the through-hole 111 of the roller part 110 so that the insertion-direction distal end of the rotary shaft 120 is guided into the inside periphery of the above snap fit portion 116 spirally formed and extended outward in the axial direction. This insertion-direction distal end of the rotary shaft 120 is contacted against the above engagement protrusion 117 formed on the inside periphery of the snap fit portion 116 so that the snap fit portion 116 is biased in a direction to be extended outward in the axial direction. On the other hand, the positioning retention part 121 of the rotary shaft 120 is contacted against the projection 114 on the one end of the cylindrical base 112 of the roller part 110 so that the rotation transmission engagement portion 122 having the protruded shape and disposed at the positioning retention part 121 of the rotary shaft 120 is engaged with the groove-like rotation transmission engagement portion 115 formed in the above projection 114 of the roller part 110.

Figure 4C:
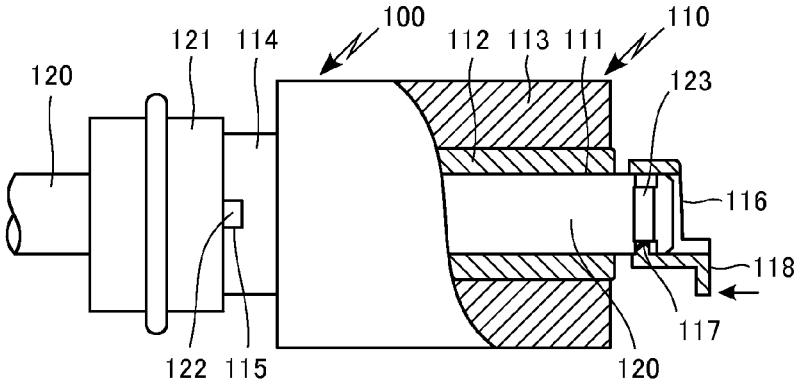
FIG. 4C is a schematic explanatory diagram partly in section showing the above roller member where a press portion formed at an extended-side end of the snap fit portion is depressed so as to bring the engagement protrusion formed at the snap fit portion into engagement with an engagement recess formed at the rotary shaft.

Next, as shown in FIG. 4C, the press portion 118 at the extended-side end of the above snap fit portion 116 is pressed with a finger or the like in the direction opposite to the extension direction of the snap fit portion 116 so that the above engagement protrusion 117 on the inside periphery of the snap fit portion 116, in contact against the insertion-direction distal end of the rotary shaft 120, is depressed toward the above engagement recess 123 formed at the insertion-direction distal end of the rotary shaft 120. Thus, this engagement protrusion 117 is brought into engagement with the engagement recess 123 of the rotary shaft 120 in the state where the snap fit portion 116 is elastically deformed in the direction opposite to the extension direction thereof.

Figure 4D:
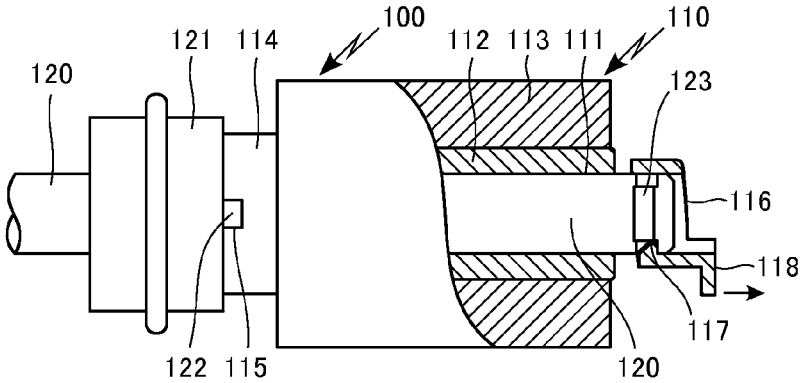
FIG. 4D is a schematic explanatory diagram partly in section showing the above roller member where the press portion is released from the depression so that the one end of the roller part is pressed against and retained on the positioning retention part of the rotary shaft by an elastic restoring force of the snap fit portion.

When the snap fit portion 116 with the engagement protrusion 117 thereof engaged with the engagement recess 123 of the rotary shaft 120 is released from the pressure on the press portion 118 thereof, as shown in FIG. 4D, the snap fit portion 116 with the above engagement protrusion 117 engaged with the engagement recess 123 of the rotary shaft 120 is biased in the extension direction by an elastic restoring force of the snap fit portion 116 elastically deformed in the direction opposite to the extension direction, while the reaction force acts to press the projection 114 at the one end of the roller part 110 toward the positioning retention part 121 of the rotary shaft 120.

As a result, the projection 114 at the one end of the roller part 110 is pressed against the positioning retention part 121 of the rotary shaft 120 so that this roller part 110 is properly retained without rattling by the positioning retention part 121 of the rotary shaft 120. Further, in the state where the rotation transmission engagement portion 122 having the protruded shape and disposed at the positioning retention part 121 of the rotary shaft 120 is properly engaged with the groove-like rotation transmission engagement portion 115 formed in the above projection 114 of the roller part 110, the roller part 110 is properly rotated in conjunction with the rotation of the rotary shaft 120.

Figure 5:
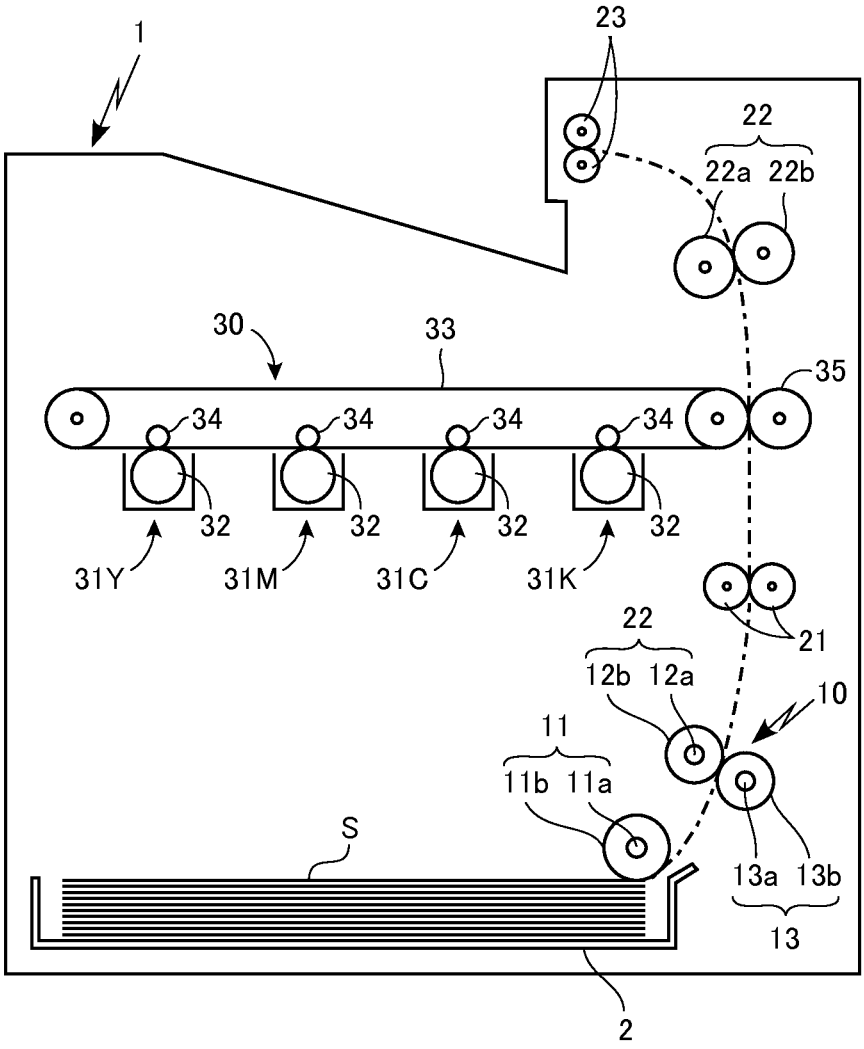
FIG. 5 is a schematic explanatory diagram showing an example where the above roller member is applied to a sheet feeder in an image forming apparatus.

Next, description is made on a case where the above-described roller member 100 is applied to a sheet feeder 10 in an image forming apparatus 1 as shown in FIG. 5. The sheet feeder 10 is adapted to feed a sheet S stored in a paper cassette 2 removably loaded in the image forming apparatus 1 and disposed at a lower part thereof.

The above sheet feeder 10 operates as follows. A pickup roller 11 is contacted onto the sheets S stored in the paper cassette 2 with a suitable pressure. In this state, the above pickup roller 11 is rotated to feed the sheet S from the paper cassette 2. This sheet S is guided into nip between a feed roller 12 and a separation roller 13. In the event of a multiple feed, the multiply fed sheets S are separated in the nip between the feed roller 12 and the separation roller 13 so that one sheet S is allowed to pass through the nip between the feed roller 12 and the separation roller 13 and then discharged.

This sheet feeder 10 is designed to apply the above-described roller member 100 to at least one of the above pickup roller 11, feed roller 12 and separation roller 13.

If the above roller member 100 is used as the above pickup roller 11, feed roller 12 or separation roller 13, a roller part 11*b* mounted on a rotary shaft 11*a* of the pickup roller 11, a roller part 12*b* mounted on a rotary shaft 12*a* of the feed roller 12 of a roller part 13*b* mounted on a rotary shaft 13*a* and the separation roller 13 are prevented from rattling when the sheet S is fed from the paper cassette 2 in the above-described manner. It is thus ensured that the sheets S are properly fed from the paper cassette 2 while obviating misfeed as the result of shifted sheets S.

In this image forming apparatus 1, the sheet S transported through the nip between the feed roller 12 and the separation roller 13, as described above, is delivered to a registration roller 21 which, in turn, feeds the sheet S to an image forming part 30 according to an image forming timing of the image forming part 30.

The above image forming part 30 includes a yellow-color imaging unit 31Y, a magenta-color imaging unit 31M, a cyan-color imaging unit 31C and a black-color imaging unit 31K. Each of the imaging units 31Y, 31M, 31C, 31K is provided with a photoreceptor drum 32 on which a toner image is formed. Arranged around the photoreceptor drum 32 are a charging unit, an exposure unit, a developing unit, a cleaning unit and the like which are not shown in the figure. The image forming unit further includes: primary transfer rollers 34 for transferring the toner images formed on the respective photoreceptor drums 32 of the imaging units 31Y, 31M, 31C, 31K to an intermediate transfer belt 33; a secondary transfer roller 35 for transferring the toner image transferred to the intermediate transfer belt 33 to the above sheet S; and the like.

In this image forming part 30, the toner images of the respective colors are formed on the photoreceptor drums 32 of the imaging units 31Y, 31M, 31C, 31K according to image information. The toner images of the respective colors formed on the respective photoreceptor drums 32 are sequentially primarily transferred onto the intermediate transfer belt 33 by the respective primary transfer rollers 34 so as to form a full color toner image on the intermediate transfer belt 33.

According to a timing when the full color toner image formed on the intermediate transfer belt 33 is delivered to place opposite the secondary transfer roller 35, the above registration roller 21 delivers the sheet S to nip between the intermediate transfer belt 33 and the secondary transfer roller 35 so that the toner image on the intermediate transfer belt 33 is transferred to the sheet S.

Subsequently, the sheet S with the toner image transferred thereto is delivered to a fixing unit 22 provided with a heat roller 22*a* and a pressure roller 22*b*. The toner image transferred to the sheet S is fixed to the sheet S by heating and pressurizing the sheet S with the toner image formed thereon in the nip between the heat roller 22*a* and the pressure roller 22*b*. The sheet S with the fixed toner image is discharged by a discharge roller 23.

While the description of this embodiment is made on the case where the above-described roller member 100 is applied to the sheet feeder 10 of the image forming apparatus 1, the use of the above-described roller member 100 is not particularly limited. The roller member 100 is also applicable to a component of a device other than the sheet feeder 10 in the image forming apparatus 1.

Although the present invention has been fully described by way of examples, it is to be noted that various changes and modifications will be apparent to those skilled in the art.

Therefore, unless otherwise such changes and modifications depart from the scope of the invention, they should be construed as being included therein.

The invention claimed is:

1. A roller member comprising:

a rotary shaft;

a roller part including a through-hole for insertion of the rotary shaft and removably mounted on a periphery of the rotary shaft; and a positioning retention part for positioning one end of the roller part, wherein the rotary shaft includes an engagement recess having a concave shape and formed in a portion extended beyond the other end of the roller part mounted on the rotary shaft, the roller part includes a snap fit portion which is extended axially outward from the other end thereof and includes an engagement protrusion for engagement with the engagement recess, and the snap fit portion brings the engagement protrusion into engagement with the engagement recess as elastically deformed in a direction opposite to its extension direction, while the one end of the roller part is pressed against the positioning retention part by an elastic restoring force of the snap fit portion.

2. The roller member according to claim 1, wherein the roller part comprises a cylindrical base including the through-hole, and an elastic roller formed of an elastic material and mounted on a periphery of the cylindrical base, and the snap fit portion is extended axially outward from the other end of the cylindrical base of the roller part.

3. The roller member according to claim 1, wherein the snap fit portion is provided with a press portion for permitting this snap fit portion to be depressed in the direction opposite to the extension direction.

4. The roller member according to claim 1, wherein the snap fit portion is spirally formed in a circumferential direction of the rotary shaft and extended axially outward from the other end of the roller part.

5. The roller member according to claim 1, wherein the positioning retention part of the rotary shaft and the one end of the roller part positioned and retained by this positioning retention part are each provided with a rotation transmission engagement portion for transmitting the rotation of the rotary shaft to the roller part.

6. A sheet feeder for feeding a sheet by means of a roller member, wherein the roller member according to claim 1 is used as the roller member.

7. An image forming apparatus provided with a sheet feeder for feeding a sheet by means of a roller member, wherein the sheet feeder according to claim 6 is used as the sheet feeder.

* * * * *